US007168704B1

(12) United States Patent
Lawless

(10) Patent No.: US 7,168,704 B1
(45) Date of Patent: Jan. 30, 2007

(54) INTERACTIVE GAME

(76) Inventor: Robert L. Lawless, 1110 E. Geneva Dr., Tempe, AZ (US) 85282

( * ) Notice: Subject to any disclaimer, the term of this patent is extended or adjusted under 35 U.S.C. 154(b) by 44 days.

(21) Appl. No.: 10/934,807

(22) Filed: Sep. 3, 2004

Related U.S. Application Data

(60) Provisional application No. 60/500,025, filed on Sep. 4, 2003.

(51) Int. Cl.
*A63F 3/00* (2006.01)

(52) U.S. Cl. ..... 273/237; 273/271; 273/274

(58) Field of Classification Search ..... 273/271, 273/236–238, 248, 249, 282.3, 288, 284, 273/273; 434/188, 191, 200, 205, 209
See application file for complete search history.

(56) References Cited

U.S. PATENT DOCUMENTS

| | | | | |
|---|---|---|---|---|
| 711,959 | A | 10/1902 | Graham | |
| 1,480,360 | A | 1/1924 | Agee | |
| 1,521,095 | A | 12/1924 | Harris | |
| 1,714,792 | A | 5/1929 | Kurihara | |
| 3,659,851 | A | 5/1972 | Lang et al. | |
| 4,196,905 | A | 4/1980 | Yanari | |
| 4,213,616 | A | 7/1980 | Dickey | |
| 4,302,015 | A * | 11/1981 | Bowser et al. | 273/271 |
| 5,026,070 | A | 6/1991 | Watt | |
| 5,301,952 | A | 4/1994 | Fitzgerald | |
| 5,688,126 | A | 11/1997 | Merritt | |
| 6,206,372 | B1 * | 3/2001 | Harris | 273/153 S |
| 6,325,374 | B1 | 12/2001 | Burger et al. | |
| 2002/0015936 | A1 * | 2/2002 | Donn | 434/209 |
| 2003/0100356 | A1 * | 5/2003 | Brown et al. | 463/9 |
| 2003/0125100 | A1 * | 7/2003 | Cannon | 463/16 |

FOREIGN PATENT DOCUMENTS

GB 1377366 A * 12/1974

* cited by examiner

*Primary Examiner*—John M. Hotaling, II
*Assistant Examiner*—Alex F. R. P. Rada, II
(74) *Attorney, Agent, or Firm*—Venable, Campillo, Logan & Meaney PC

(57) ABSTRACT

A method and apparatus for amusement and gaming is described. The apparatus includes a board comprising horizontal and vertical disposed lines that enclose a plurality of playing areas, wherein the playing areas are arranged into an equal number (N) of rows and columns of at least 10, and each playing area in a row and column contains an indicia corresponding to a first through an N-th number to identify the playing area in each row and column wherein each row and column may not repeat an indicia, and a plurality of game pieces comprising a first side and a second side wherein the first side is distinguishable from the second side and comprising N sets of game pieces having on both the first side and the second side the same indicia corresponding to a first through N-th number. The apparatus may tangible or virtually generated.

6 Claims, 4 Drawing Sheets

50

300

| | 201 | 202 | 203 | 204 | 205 | 206 | 207 | 208 | 209 | 210 | 211 | 212 |
|---|---|---|---|---|---|---|---|---|---|---|---|---|
| 101 | 1 | 2 | 3 | 4 | 5 | 6 | 7 | 8 | 9 | 10 | 11 | N=12 |
| 102 | 2 | 3 | 4 | 5 | 6 | 7 | 8 | 9 | 10 | 11 | 12 | 1 |
| 103 | 3 | 4 | 5 | 6 | 7 | 8 | 9 | 10 | 11 | 12 | 1 | 2 |
| 104 | 4 | 5 | 6 | 7 | 8 | 9 | 10 | 11 | 12 | 1 | 2 | 3 |
| 105 | 5 | 6 | 7 | 8 | 9 | 10 | 11 | 12 | 1 | 2 | 3 | 4 |
| 106 | 6 | 7 | 8 | 9 | 10 | 11 | 12 | 1 | 2 | 3 | 4 | 5 |
| 107 | 7 | 8 | 9 | 10 | 11 | 12 | 1 | 2 | 3 | 4 | 5 | 6 |
| 108 | 8 | 9 | 10 | 11 | 12 | 1 | 2 | 3 | 4 | 5 | 6 | 7 |
| 109 | 9 | 10 | 11 | 12 | 1 | 2 | 3 | 4 | 5 | 6 | 7 | 8 |
| 110 | 10 | 11 | 12 | 1 | 2 | 3 | 4 | 5 | 6 | 7 | 8 | 9 |
| 111 | 11 | 12 | 1 | 2 | 3 | 4 | 5 | 6 | 7 | 8 | 9 | 10 |
| 112 | N=12 | 1 | 2 | 3 | 4 | 5 | 6 | 7 | 8 | 9 | 10 | 11 |

INTERACTIVE GAME

FIELD OF THE INVENTION

The present invention relates generally to physical and electronic board games and more particularly, but not by way of limitation, physical and electronic board games involving the placement of game pieces. This application claims priority to copending U.S. Provisional Patent Application entitled "Interactive Game", having a Ser. No. 60/500,025, filed on Sep. 4, 2003, which is entirely incorporated herein by reference.

BACKGROUND

Games using game boards and games of this type involving numerical determinations and mental processes in the playing of the game are well known. Many of the games of this type are either quite simple, very complicated or combine the board game with other games such as cards or dice; thus the attraction of the player may wane. Likewise, none of these games employ a multiplicative scoring system.

Further, it is well known that gaming machines include a variety of games; for example, slot, keno, poker, etc. Gaming machines can also be programmed to play a variety of games. These gaming machines typically require a monetary amount to be entered into the gaming machine before play begins. For example; players may insert coin, token, paper currency, magnetic cards, or other suitable entry credits, such as digital signals representing a monetary amount, into the gaming machine. Such operation of gaming machines is well know.

Various board games have been proposed in the art, such as U.S. Pat. Nos. 6,325,374; 5,688,126; 5,301,952; 5,026,070; 4,302,015; 4,213,616; 4,196,905; 3,659,851; 1,714,792; 1,521,095; 1,480,360; and 711,959 each of the foregoing in United States patents are hereby incorporated herein by reference.

SUMMARY OF THE INVENTION

It is an object of the present invention to provide a gameboard type game that provides a novel game involving both mental acuity and chance in a manner that is challenging and at the same time relatively easy and quick to learn. It is a further object of this invention to provide a game board type game that involves only the gameboard and game pieces.

It is another object of this invention to provide a gameboard type game that can be used to educate player to use multiplication. Another object of this invention is to provide a virtual gameboard and game pieces; for example, as a computer program used with a computer. It is yet another object of this invention to provide the virtual game board and game pieces so that players may play against the computer; against another player at the same physical location or against another player over the internet.

It is another object of this invention that the gameboard type game may be used for gaming purposes; wherein wagers are placed. Preferably the gameboard type game may be played in a gaming area using a table; more preferably the invention may be integrated into a gaming machine for placing wagers; most preferably, a gaming system using the invention could be used to virtually connect two or more players so they may place wagers.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. § 112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

FIG. 4 *a* shows an expanded block diagram of one preferred embodiment of a method of the invention shown in FIG. 4.

DESCRIPTION

Figures 1, 2:
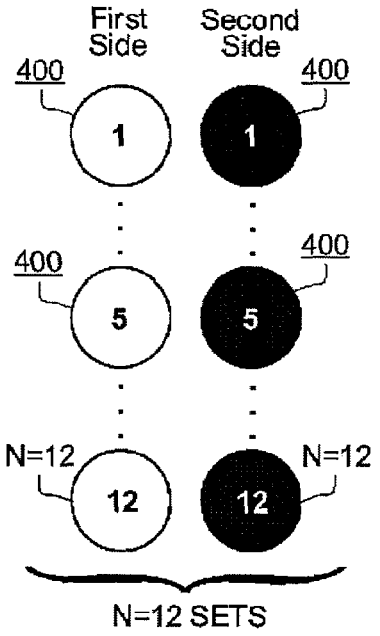
FIG. 1 is a plan view of a gameboard for a preferred embodiment of the invention
FIG. 2 is a first side view and a second side view of one preferred embodiment of a plurality game piece of the invention where n equals 12.

Referring now to the drawings and in particular to FIG. 1 there is depicted a game board 50 which is divided into rows 101 to 112 and columns 201 to 212; and each playing area 300 is formed by the intersection of the rows and columns. In the preferred embodiment show in FIG. 1, the game board 50 includes twelve rows and twelve columns. It is to be understood, however, that the game board of the invention may includes any equal number (N) of rows and columns where N is at least ten; for example, the game board 50 in FIG. 1 has an equal number of rows and columns where N is equal to twelve.

It is noted that in the preferred example of FIG. 1 each playing area 300 of the game board 50 includes an indicia in the form of a numeric. In the preferred example of FIG. 1, the indicia in playing area corresponding to the intersection of row 101 and column 201 is the number 1. Preferably in this invention, the indicia may be any pictorial representation, and more preferably the indicia such as an alphanumeric or other representation, and most preferably the indicia a numbers from 1 to N. Also, in the preferred embodiment, each row and column contains N different indicia, more preferably N different and ordered indicia, and most preferably numbers ordered from 1 to N. For example, in the preferred embodiment of FIG. 1, the playing areas in row 101 are consecutively numbered starting with 1 through 12, playing areas in row 102 are consecutively numbered starting with 2 through 12 and then returning to 1, etc. It is noted, however, that this is just one way in which the game board may be ordered so long as no row or column contains the same indicia more than once.

FIG. 2 refers to a preferred embodiment of the plurality of game pieces 400. The game pieces 400 may be of any geometry, such a disc, squares, cubes, etc., so long as there is one game piece corresponding to every indicia on the game board and game pieces have a first side and a second side such that the first side is distinguishable from the second side and both sides are marked with the indicia. For example, the game board 50 represented in FIG. 1 would use 12 sets game pieces numbered 1 through 12 on both sides (i.e. 144 total game pieces) and the first sides and second sides of each game piece would be distinguishable; for example by color.

The instant game may be played by a plurality of players or player teams where the minimum number of players is two, but in one preferred embodiment of this invention one of the two players may be a computer program. To play the preferred embodiment of the game, six game pieces are randomly dispensed to the initial or first player; for example in one embodiment of the invention the player may pick the six game pieces from a bag and in another embodiment of the invention a computer may randomly select six game pieces. In the preferred embodiment of the invention, each player or player team is designated one side of the game pieces 400; more preferably designating the side is accomplished by the player or player team selecting the side; and most preferably designating the side is accomplished by assigning the side to the player or player team. In the preferred embodiment, the first player then plays the six game pieces 400 with the first player's side of the game piece face up on the game board 50 such that two game pieces with the same side face up are always contiguous (vertically, horizontally, or diagonally) in the game board. If any of the game pieces 400 in each player's turn can not be placed on the game board 50, then the unplayable game pieces are placed in a reuse area. In a preferred embodiment of the invention, play continues in a sequential manner (turns) with six game pieces are randomly dispensed to next player until all game pieces are played on the board (in the next player's side) except those rthat may be held in the reuse area. In the preferred embodiment of the invention, after all of the game pieces have been dispensed, each player in turn tries to place the unplayed game pieces on the game board, but if a player is still unable to place the unplayed game piece on the game board, the game piece is converted (or "flipped" to the other side of the game piece) and played for the opposing player(s). In another embodiment of this invention the game pieces in the reuse area may be replaced into the disperser at any time during the play of the game.

The strategy of the game employing the game board 50 requires that any player complete or block your opponents completion of at least six contiguous game pieces in any row, column, or diagonal. In the preferred embodiment of the invention, the winner is determined by the number and length of the contiguous game pieces. In a more preferred embodiment of the invention, each player would receive a score based on adding the squares of length of the at least six contiguous game pieces; for example if a player had two sets of six contiguous game pieces and one set of seven contiguous game pieces the player's score would be $6^2+6^2+7$ equaling 121.

Figure 3:
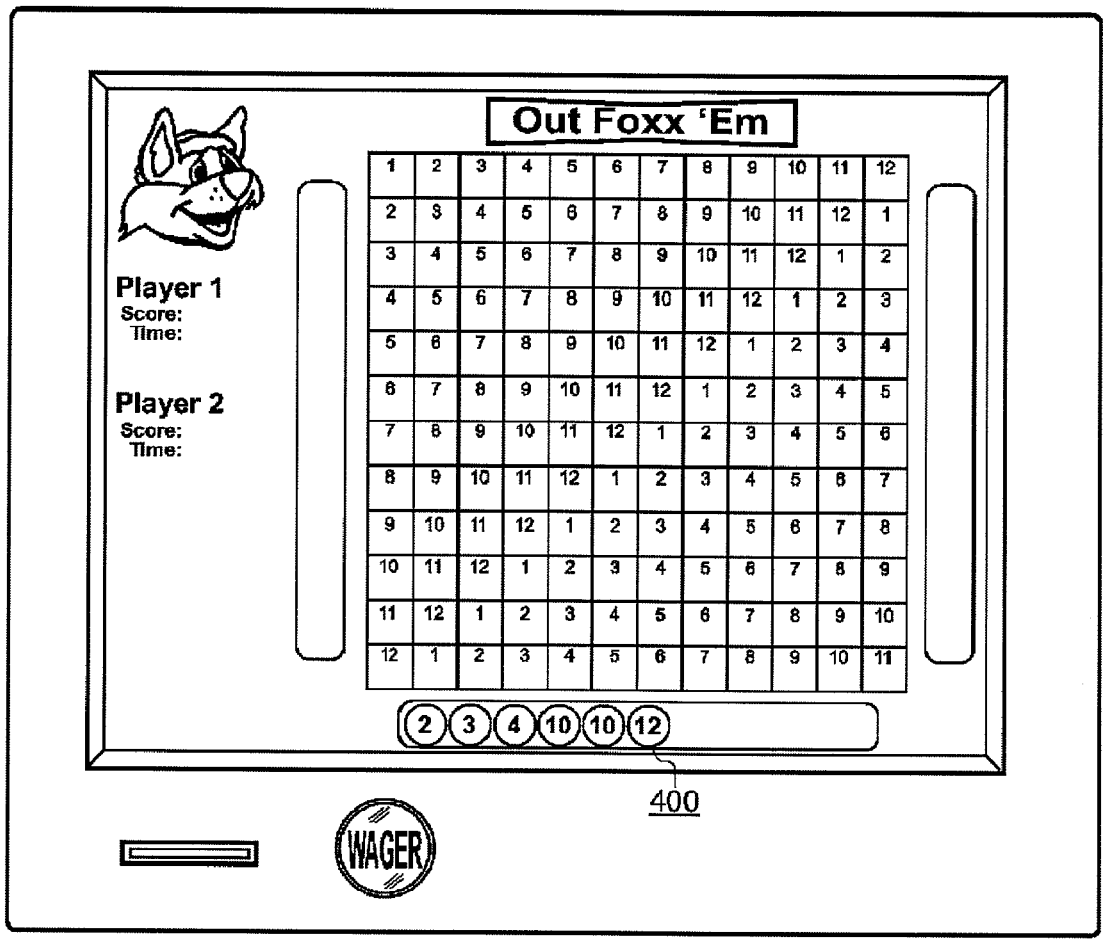
FIG. 3 shows one preferred embodiment of showing a display screen and a wager accepting device of the invention

In yet another preferred embodiment of this invention, the game may be programmed into a computer. In this preferred embodiment, the computer program generates a virtual game board and randomly dispenses game pieces; for example as shown in FIG. 3. The player may, in a preferred embodiment, then place the virtual game pieces on the virtual game board by selecting the virtual game piece using a mouse and dragging the virtual game piece to the appropriate virtual playing area on the virtual game board. The computer program may also be programmed to act as a player. Further, the computer program can be used to allow players to play the game over a computer network such as the internet. For example, a player may using the computer version of the invention may select the computer to host through identification of the internet protocol address and another player using the same program on a different computer may link to the host computer. Other methods of networking computers are known.

In yet another embodiment of the invention, for example as also shown in FIG. 3, the game may be used for wagering, and in a more preferred embodiment the game may be programmed into a gaming machine (examples of other games that have been programmed into a gaming machines include video poker, keno, etc.) where a player would wager and play against either the gaming machines, other player(s), or combinations of gaming machines and player(s). Further, the gaming machines and player may be place wagers and receive winnings over a computer network.

Figure 4:
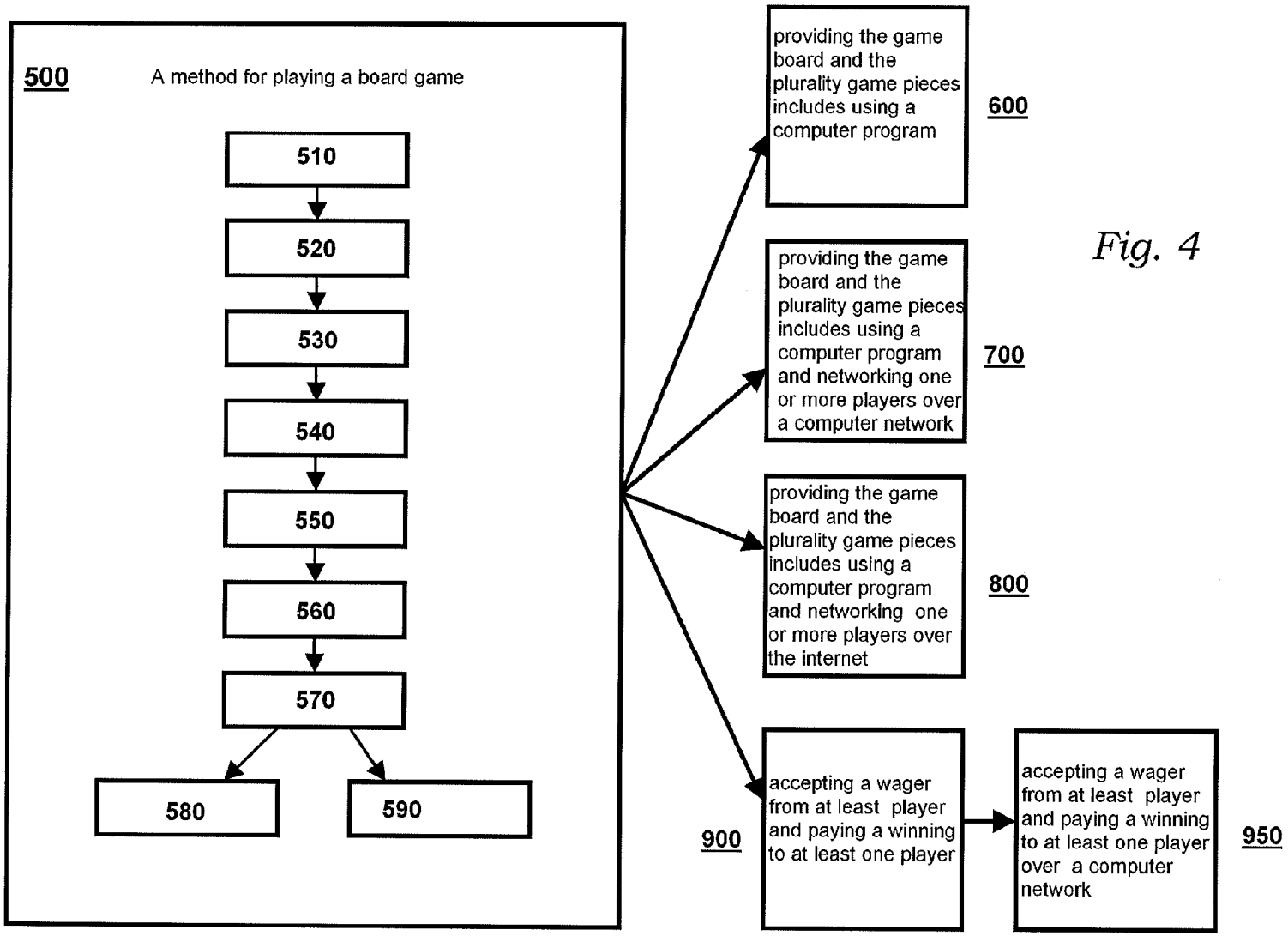
FIG. 4 shows a block diagram of one preferred embodiment of a method of the invention.
Figure 4A:
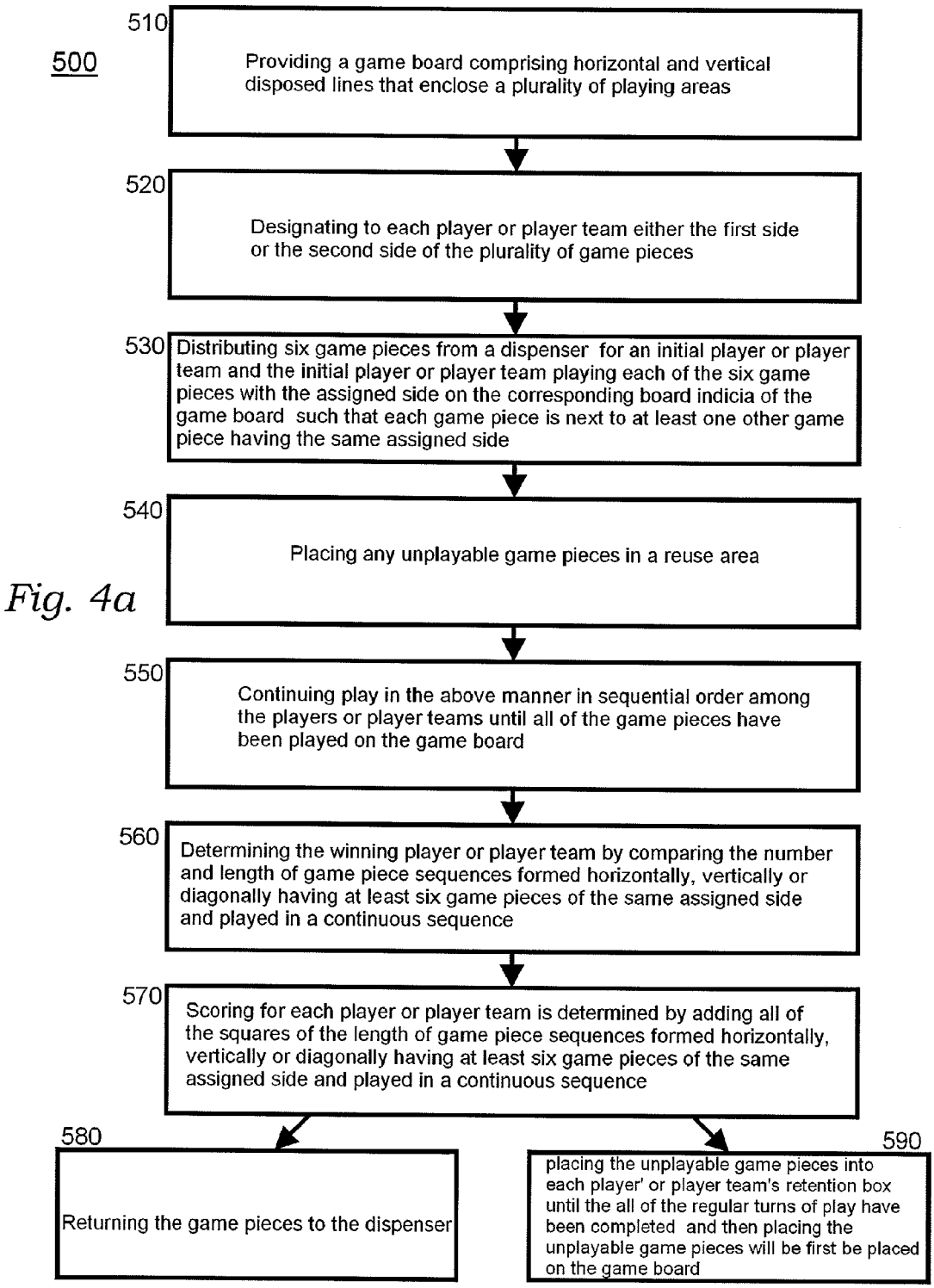

In yet another embodiment of the invention as shown in FIG. 4 and FIG. 4*a*, a method for playing a board game 500, comprises the steps of: Providing a game board comprising horizontal and vertical disposed lines that enclose a plurality of playing areas 510, wherein the playing areas are arranged into an equal number (N) of rows and columns of at least 10, and each playing area in a row and column contains an indicia corresponding to a first through an N-th number to identify the playing area in each row and column wherein each row and column may not repeat an indicia, and a plurality of game pieces comprising a first side and a second side wherein the first side is distinguishable from the second side and comprising N sets of game pieces having on both the first side and the second side the same indicia corresponding to a first through N-th number; designating to each player or player team either the first side or the second side of the plurality of game pieces 520; distributing six game pieces from a dispenser for an initial player or player team and the initial player or player team playing each of the six game pieces with the assigned side on the corresponding board indicia of the game board such that each game piece is next to at least one other game piece having the same assigned side 530; placing any unplayable game pieces in a reuse area 540; continuing play in the above manner in sequential order among the players or player teams until all of the game pieces have been played on the game board 550; determining the winning player or player team by comparing the number and length of game piece sequences formed horizontally, vertically or diagonally having at least six game pieces of the same assigned side and played in a continuous sequence 560. Preferably, the step of determining the winning player or player team comprises the steps of: scoring for each player or player team is determined by adding all of the squares of the length of game piece sequences formed horizontally, vertically or diagonally having at least six game pieces of the same assigned side and played in a continuous sequence 570. More preferably, the step of placing any unplayable game pieces in a reuse area comprises the steps of: returning the game pieces to the dispenser 580. Also preferably, the step of placing any unplayable game pieces in a reuse area comprises the steps of: placing the unplayable game pieces into each player' or player team's retention box until the all of the regular turns of play have been completed and then placing the unplayable game pieces will be first be placed on the game board if the unplayable game piece is next to at least one other game piece having the same assigned side else the unplayable game piece will be flipped to other side and placed on the game board 590. Additional preferred embodiments may include one or more of the following steps: providing the game board and the plurality game pieces includes using a computer program 600; providing the game board and the plurality game pieces includes using a computer program and networking one or more players over a computer network 700; and providing the game board and the plurality game pieces includes using a computer program and networking one or more players over the internet 800. Another preferred embodiments may include one or more of the following steps: accepting a wager from at least player and paying a winning to at least one player 900; and, more preferably, accepting a wager from at least player and paying a winning to at least one player further comprises accepting a wager from at least player and paying a winning to at least one player over a computer network 950.

EXAMPLE

A Working Computerized Version

What the Computer version supplies: A virtual game board, resembling the board game version is depicted on the screen, with 144 playing spaces (like FIG. 1): 12 each of numbers 1 thru 12. The computer version allows the players to choose on-line play, play between two individuals at the same location or play with a human player against the computer (see FIG. 3). The computer program also allows a player to choose whether they will play first or second, and the player can select a time limit per each player's turn. For example, if no time limit is selected the computer may set the time limit of 10 minutes per turn. Optionally, the computer version could be programmed to limit the time of the entire game.

In this example, each turn the computer randomly dispenses six virtual game pieces (hereafter referred to as "game discs") and color (i.e. side of the game piece) to whichever player (human or computer) has the turn. After the each player's turn is completed, the computer will dispense six discs to the other player (human or computer).

The dispensed game discs are played on corresponding numbers (indicia) on the virtual game board with the requirement that each game disc must be played adjacent to another game disc of the same color. Two same colored game discs may be played together, or a game disc may be played next to an established sequence of two or more discs of the same color. In any event, all game discs must always have a "buddy" meaning there can never be a disc played in isolation without at least one other contiguous same colored game disc. For example, when a game disc is played in a location where it is not touching another same colored game disc, the computer program will encircle the number in a yellow square if the player has another unplayed game disc that can be adjoined to the game disc with the yellow square. If none exists, the computer will refuse the placement of a lone game disc which cannot be joined by a "buddy" during that particular turn of play. If such game discs can be played touching a previously played game disc of the same color, the player can place the game disc accordingly.

If no placement of a game disc or game discs is possible for the respective turn of play, the computer, after all playable game discs have been played, will reuse the game disc by putting such game disc or game discs in the player's reuse area (also called a "retention" box). After both players, (human or computer) have completed all regular turns of play, the computer will then place any unplayed game disc or game discs in the retention boxes, first to the respective player's game discs if they can meet the "buddy" requirement of touching a game disc of the same color, if not the computer will "flip" the game discs to the opponent's color and place them next to a game disc belonging to the opponent. In such instances, the placement may or may not provide or add to a score, depending on the number of game discs in the sequence being increased.

In this preferred embodiment of the invention, the computer will record points scored as the game proceeds. The requirement is that at least six game discs of the same color (side) must be played in a continuous string before scoring occurs. At that time the number of game discs played will be squared; for example, 36 points for six contiguous game discs, 49 for seven six contiguous game discs, etc. Any later played additional game disc or game discs added to a string of six or more will be recorded and tallied to reflect the aggregate squared score. Scoring is done for disc sequences formed horizontally, vertically or diagonally. For example six or more 10's 11's, 12's, etc.

The computer directs players how to quit the game or play again.

Numbers on the Board (for example 12) Can be included in as many as three rows for scoring purposes, if horizontal, vertical and diagonal same number rows intersect; for example:

| | | | | | | |
|---|---|---|---|---|---|---|
| | | | 9 | | | 12 |
| | | | 10 | | 12 | |
| | | | 11 | 12 | | |
| 9 | 10 | 11 | 12 | 1 | 2 | |
| | | 12 | 1 | | | |
| | 12 | | 2 | | | |

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A method for playing a board game, comprising the steps of:

Providing a game board comprising horizontal and vertical disposed lines that enclose a plurality of playing areas, wherein the playing areas are arranged into an equal number (N) of rows and columns of at least 10, and each playing area in a row and column contains an indicia corresponding to a first through an N-th number to identify the playing area in each row and column wherein each row and column may not repeat an indicia, and a plurality of game pieces comprising a first side and a second side wherein the first side is distinguishable from the second side and comprising N sets of game pieces having on both the first side and the second side the same indicia corresponding to a first through N-th number;

designating to each player or player team either the first side or the second side of the plurality of game pieces;

distributing six game pieces from a dispenser for an initial player or player team and the initial player or player team playing each of the six game pieces with the assigned side on the corresponding board indicia of the game board such that each game piece is next to at least one other game piece having the same assigned side;

placing any unplayable game pieces in a reuse area comprising the step of placing the unplayable game pieces into each player' or player team's retention box until the all of the regular turns of play have been completed and then the unplayable game pieces will be first be placed on the game board if the unplayable game piece is next to at least one other game piece having the same assigned side else the unplayable game piece will be flipped to other side and placed on the game board;

continuing play in the above manner in sequential order among the players or player teams until all of the game pieces have been played on the game board;

determining the winning player or player team by comparing the number and length of game piece sequences formed horizontally, vertically or diagonally having at least six game pieces of the same assigned side and played in a continuous sequence comprising the step of scoring for each player or player team is determined by adding all of the squares of the length of game piece sequences formed horizontally, vertically or diagonally having at least six game pieces of the same assigned side and played in a continuous sequence.

2. The methods for playing a board game of claim 1 the step of providing the game board and the plurality game pieces includes using a computer program.

3. The methods for playing a board game of claim 1 the step of providing the game board and the plurality game pieces includes using a computer program and networking one or more players over a computer network.

4. The methods for playing a board game of claim 1 the step of providing the game board and the plurality game pieces includes using a computer program and networking one or more players over the internet.

5. The methods for playing a board game of claim 1 further comprising the steps of accepting a wager from at least player and paying a winning to at least one player.

6. The methods for playing a board game of claim 5 wherein the step of accepting a wager from at least player and paying a winning to at least one player further comprises accepting a wager from at least player and paying a winning to at least one player over a computer network.

* * * * *

UNITED STATES PATENT AND TRADEMARK OFFICE

CERTIFICATE OF CORRECTION

PATENT NO. : 7,168,704 B1
APPLICATION NO. : 10/934807
DATED : January 30, 2007
INVENTOR(S) : Robert L. Lawless It is certified that error appears in the above-identified patent and that said Letters Patent is hereby corrected as shown below:

Column 4, lines 5 - 6 "$6^2$+ $6^2$+ 7 equaling 121." should read -- $6^2$+ $6^2$+ $7^2$ equaling 121. --

Signed and Sealed this

First Day of May, 2007

JON W. DUDAS
*Director of the United States Patent and Trademark Office*